United States Patent [19]

Lysenko et al.

[11] 4,412,929

[45] Nov. 1, 1983

[54] MAGNETIC WALL COVERING COMPOSITION

[76] Inventors: Paul D. Lysenko; Natalie Lysenko, both of 214 Hungerford St., Pittsfield, Mass. 01201

[21] Appl. No.: 356,968

[22] Filed: Mar. 10, 1982

[51] Int. Cl.[3] ..... H01F 10/02

[52] U.S. Cl. ..... 252/62.53; 252/62.54

[58] Field of Search ..... 252/62.53, 62.54

[56] References Cited

U.S. PATENT DOCUMENTS

| | | | |
|---|---|---|---|
| 2,564,312 | 8/1951 | Rossmann et al. | 252/62.53 X |
| 3,029,157 | 4/1962 | Sutheim et al. | 252/62.53 |
| 3,810,840 | 5/1974 | van Ruler et al. | 252/62.54 |
| 4,172,176 | 10/1979 | Tanaka et al. | 428/411 |
| 4,201,809 | 5/1980 | Ogawa et al. | 428/65 |

FOREIGN PATENT DOCUMENTS

| | | | |
|---|---|---|---|
| 1297463 | 5/1962 | France | 252/62.53 |

*Primary Examiner*—F. Edmundson

[57] ABSTRACT

A magnetic wall covering composition consisting of magnetic iron oxide particles and glue.

1 Claim, No Drawings

MAGNETIC WALL COVERING COMPOSITION

BACKGROUND OF THE INVENTION

Hanging pictures and other objects on a wall using nails limits the flexibility of positioning them and results in unsightly wall damage when changes are made.

SUMMARY OF THE INVENTION

The object of the invention is to produce a wall coating composition having magnetic properties so that wall hangings having magnets of adequate size on their backs can be placed anywhere at will on any surface coated with the magnetic composition.

The magnetic composition consists of a dispersion of particles of $Fe_3O_4$ in glue.

A dispersion is prepared from 100 parts of $Fe_3O_4$ particles in which 60–90% of the particles pass a 325 mesh screen. The particles are dispersed in 15–25 parts of glue such as Solomon Sobo Glue.

What is claimed is:

1. A magnetic coating composition consisting of 100 parts by weight of magnetic iron oxide particles, 60–90% of which pass 325 mesh, and 15–25 parts of weight of glue.

* * * * *